US010443341B2

(12) United States Patent
Cour

(10) Patent No.: US 10,443,341 B2
(45) Date of Patent: Oct. 15, 2019

(54) INFLATABLE SLEEVE WITH CONTROLLED EXPANSION

(71) Applicant: CALYF, Maisons Laffitte (FR)

(72) Inventor: Francis Cour, Maisons Lafitte (FR)

(73) Assignee: CALYF, Maisons Laffitte (FR)

( * ) Notice: Subject to any disclaimer, the term of this patent is extended or adjusted under 35 U.S.C. 154(b) by 96 days.

(21) Appl. No.: 14/913,643

(22) PCT Filed: Aug. 20, 2014

(86) PCT No.: PCT/EP2014/067767
§ 371 (c)(1),
(2) Date: Feb. 22, 2016

(87) PCT Pub. No.: WO2015/024980
PCT Pub. Date: Feb. 26, 2015

(65) Prior Publication Data

US 2016/0208572 A1 Jul. 21, 2016

(30) Foreign Application Priority Data

Aug. 20, 2013 (FR) ..... 13 58077

(51) Int. Cl.
*E21B 33/127* (2006.01)

(52) U.S. Cl.
CPC ..... *E21B 33/127* (2013.01); *E21B 33/1277* (2013.01)

(58) Field of Classification Search
None
See application file for complete search history.

(56) References Cited

U.S. PATENT DOCUMENTS 2,922,478 A * 1/1960 Maly ..... E21B 33/127 166/154
4,349,204 A * 9/1982 Malone ..... E21B 33/1216 166/120

(Continued)

FOREIGN PATENT DOCUMENTS

FR 2893973 A1 6/2007
FR 2910047 A1 6/2008

OTHER PUBLICATIONS

Oxford Dictionary, "Weave", 2017, https://en.oxforddictionaries.com/definition/weave , 4 pages (Year: 2017).*

*Primary Examiner* — Jennifer H Gay
(74) *Attorney, Agent, or Firm* — Knobbe, Martens, Olson & Bear, LLP

(57) ABSTRACT

The inflatable sleeve (13) comprises:

a mandrel (15) extending in a longitudinal direction;

an inflatable casing (17) placed around the mandrel (15);

a tubular sheath (19) slid around the casing (17), the tubular sheath (19) having a central segment (27) and first and second longitudinal ends (23, 25) situated on either side of the central segment (27), the first and/or second ends (23, 25) of the tubular sheath (19) being fixed to the mandrel (15), the tubular sheath (19) being extensible from a rest state to an expanded state.

The tubular sheath (19) has a predetermined circumferential elongation capacity from the rest state of the tubular sheath (19); and the first and/or second ends (23, 25) of the tubular sheath (19) have a longitudinal elongation capacity from the rest state of the tubular sheath (19) comprised between 1.05 and 2.5, chosen to limit the diametric expansion of (Continued)

the first and/or second ends (23, 25) of the tubular sheath and give the first and/or second ends their shape (23, 25).

13 Claims, 4 Drawing Sheets

(56) References Cited

U.S. PATENT DOCUMENTS 4,768,590 A * 9/1988 Sanford ..... E21B 33/1277 166/187
5,101,908 A * 4/1992 Mody ..... E21B 33/1277 166/120
5,327,962 A * 7/1994 Head ..... E21B 33/1277 166/187
5,340,626 A * 8/1994 Head ..... E21B 33/1277 166/187
5,695,008 A * 12/1997 Bertet ..... D04C 1/06 166/187
5,702,109 A * 12/1997 Mahin ..... E21B 33/1277 166/187
6,595,283 B1 7/2003 Turley et al.
2004/0216871 A1* 11/2004 Mendez ..... E21B 33/1277 166/187
2006/0219400 A1* 10/2006 Xu ..... E21B 33/1216 166/187
2007/0144734 A1* 6/2007 Xu ..... E21B 33/1216 166/187
2010/0038860 A1* 2/2010 Cour ..... E21B 33/1277 277/338
2011/0094756 A1* 4/2011 Corbett ..... E21B 33/1212 166/387
2014/0196914 A1* 7/2014 Ring ..... E21B 43/103 166/387
2016/0208572 A1* 7/2016 Cour ..... E21B 33/1277

* cited by examiner

X
1
3
5
7
9
11
13
15
17
19
21
23
25
27
29
A
A'
A1
A2
A'1
A'2
B
B'
B1
B2
B'1
B'2
D0
D2
K=1.05
K=1.3
K=π/2
K=2.2

INFLATABLE SLEEVE WITH CONTROLLED EXPANSION

CROSS-REFERENCE TO RELATED APPLICATIONS

This application is the U.S. National Phase under 35. U.S.C. § 371 of International Application PCT/EP2014/067767, filed Aug. 20, 2014, which claims priority to French Patent Application No. 13 58077, filed Aug. 20, 2013. The disclosures of the above-described applications are hereby incorporated by reference in their entirety.

FIELD OF THE INVENTION

The invention generally relates to tubular sheaths, in particular inflatable sleeves used for diagraphy and the exploitation of underground boreholes.

More specifically, the invention relates to an inflatable sleeve, the sleeve comprising:

- a mandrel extending in a longitudinal direction;
- an inflatable casing placed around the mandrel;
- a tubular sheath slid around the casing, the tubular sheath having a central segment and first and second longitudinal ends situated on either side of the central segment, the first and/or second ends of the tubular sheath being fixed to the mandrel, the tubular sheath being extensible from a rest state to an expanded state.

BACKGROUND OF THE INVENTION

FR 2,910,047 describes an inflatable sleeve, also called packer by those skilled in the art, with a cylindrical sleeve made from elastomer covered with a textile containing sheath. The tubular sheath has a cylindrical shape at rest. It can be expanded to a maximum expansion state, where it adopts a predetermined profile from which it opposes a very high resistance to any additional expansion. The tubular sheath is made from a textile material, comprising elastic peripheral yarns and, secondarily, longitudinal yarns extending in a direction parallel to the axis of the sleeve. The control of the predetermined profile of the sheath is provided by the peripheral yarns. The elongation capacity and ultimate strength of these peripheral yarns are chosen as a function of the expansion rate and the strength in the expanded state desired for the sheath.

Furthermore, the application filed under number PCT/FR2013/051381 describes a hybrid elastic yarn provided to be used as peripheral yarn for the manufacture of the tubular sheath of FR 2,910,047.

The tubular sheath of FR 2,910,047 and the elastic yarn of PCT/P2013/051381 correspond perfectly to the main industrial objective for which they are intended, i.e., the prevention of the explosion of inflatable sleeves, owing to control of the profile of the tubular sheath in the expanded state. They make it possible to obtain, in the expanded state, a spindle-shaped tubular sheath profile, shown in FIG. 1. The sheath 1, in FIG. 1, has, in the expanded state, a cylindrical central segment 3 and first and second longitudinal ends 5 and 7 that are substantially frustoconical. The ends 5 and 7 have a straight section that decreases from the central segment to a ring 9 fixing the sheath 1 to the mandrel 11. The opening angle of the frustoconical ends is small, for example smaller than 30°.

In such a sheath, the longitudinal yarns only undergo very slight elongation when the sheath goes from its idle state to its expanded state. The spindle shape is controlled by gradually varying the minimum elongation level of the peripheral yarns. The maximum elongation level gradually increases along the ends 5 and 7 up to the central segment 3.

However, a tubular sheath of this type cannot be used in the case where the desired profile at the longitudinal ends of the sheath, in the expanded state, has a hemispherical shape. Such a profile is shown in FIG. 2. Indeed, for such a hemispherical profile, the diameter of the tubular sheath in the expanded state varies quite quickly at the ends. In order to obtain such a result, the maximum ultimate strength of the peripheral yarns should thus vary quite quickly from one turn to the next, which is difficult to achieve.

SUMMARY OF THE INVENTION

In this context, the invention aims to propose an inflatable sleeve that can adopt, in the expanded state, a hemispherical profile at the longitudinal ends.

To that end, the invention relates to an inflatable sleeve of the aforementioned type, characterized in that:

- the tubular sheath has a predetermined circumferential elongation capacity from the rest state of the tubular sheath; and
- the first and/or second ends of the tubular sheath have a longitudinal elongation capacity from the rest state of the tubular sheath comprised between 1.05 and 2.5, chosen to limit the diametric expansion of the first and/or second ends of the tubular sheath and give the first and/or second ends their shape.

The predetermined circumferential elongation capacity will determine the diameter of the central segment. However, at the first and/or second longitudinal end of the tubular sheath, the profile in the expanded state is controlled by the longitudinal elongation capacity, and not by the circumferential elongation capacity of the sheath. It is indeed the longitudinal elongation capacity that limits the expansion of the first longitudinal end of the sheath. If the longitudinal elongation capacity is equal to Π/2, i.e., approximately 1.57, the first longitudinal end of the sheath adopts a quarter-circle profile in the expanded state. If the longitudinal elongation capacity is greater than Π/2, the profile of the first longitudinal end will be slightly more curved in the expanded state. For a longitudinal elongation capacity below Π/2, the profile of the first longitudinal end will be slightly less curved.

Here, longitudinal elongation capacity from the rest state refers to the ratio between the developed longitudinal length of the sheath segment when the latter is expanded as much as possible, and the longitudinal length of the same segment when the sheath is in its rest state.

Likewise, circumferential elongation capacity from the rest state refers to the ratio between the maximum circumferential length of a segment of the sheath when that sheath is maximally expanded, and the circumferential length of the same sheath segment when the sheath is in its rest state.

The predetermined circumferential elongation capacity of the central segment is chosen as a function of the maximum diameter sought for the sleeve, which itself depends on the considered use of the sleeve. It may be greater than 4, and is for example comprised between 1.5 and 4. It is for example equal to 3.5.

The circumferential elongation capacity of the first and/or second ends from the rest state does not limit the diametric expansion of the sheath along the first and/or second end. This means that, if the longitudinal elongation capacity of the sheath was increased, the first and/or second sheath would undergo a greater diametric expansion. Conversely, the diameter of the junction line between the first and/or second end and the central segment would not be affected. Conversely, the longitudinal length of each end would be modified.

The fact that the first and/or second ends of the tubular sheath have a circumferential elongation capacity from the rest state of the tubular sheath close to said predetermined circumferential elongation capacity of the central segment, here denoted C, here means that the circumferential elongation capacity is comprised between C−20% and C+20%, preferably between C−10% and C+10%, and is typically equal to C.

The circumferential elongation capacity from the rest state is preferably constant along the first and/or second ends of the tubular sheath. Preferably, it is constant along the entire tubular sheath, i.e., longitudinally invariable. Alternatively, it varies slightly longitudinally, along the central segment and/or the first and second ends.

The longitudinal elongation capacity from the rest state at the first and/or second ends is comprised between 1.05 and 2.5, preferably between 1.3 and 2.2, and still more preferably between 1.4 and 2.

The sheath is typically a textile sheath, for example a woven or knit sheath.

In the case of a knit sheath, it is the appropriate choice of the knitting technique and the maximum elongation rate of the yarn used for this knitting that makes it possible to obtain the result in terms of circumferential and longitudinal elongation capacity of the sheath.

According to one advantageous aspect of the invention, the central segment of the tubular sheath has said predetermined circumferential elongation capacity, and the first and/or second ends of the tubular sheath have a circumferential elongation capacity from the rest state of the tubular sheath close to said predetermined circumferential elongation capacity of the central segment.

This makes it possible to simplify the design of the tubular sheath.

According to another advantageous aspect of the invention, the central segment and the first and second ends of the tubular sheath have substantially equal respective circumferential elongation capacities from the rest state of the tubular sheath.

This makes it possible to further simplify the design of the tubular sheath.

According to one advantageous aspect of the invention, the sheath comprises longitudinal yarns and at least one circumferential yarn,

- the circumferential yarn having a predetermined ultimate strength from the rest state of the tubular sheath; and
- the longitudinal yarns having an ultimate strength from the rest state of the tubular sheath comprised between 1.05 and 2.5 to limit the diametric expansion of the first end of the tubular sheath and give it its shape.

Such a sheath is a woven sheath.

The longitudinal yarns, for example, extend longitudinally over the entire length of the tubular sheath. The sheath for example comprises a single circumferential yarn. Alternatively, it includes several circumferential yarns. Each circumferential yarn winds around the longitudinal axis, from one longitudinal end to the other of the sheath.

Each circumferential and/or longitudinal yarn preferably has a maximum elongation rate from the rest state of the tubular sheath that is substantially constant over its entire length.

The ultimate strength from the rest state refers to the ratio between the maximum possible length of the yarn and its length when the tubular sheath is in its rest state.

It should be noted that the longitudinal and/or circumferential yarns, in the rest state of the sheath, can be in a partially elongated state. The rest state of the sheath therefore does not necessarily correspond to a rest state of the longitudinal and circumferential yarns.

Typically, the tubular sheath is cylindrical in the rest state. It has the same diameter as the mandrel. For example, it has a straight circular section, perpendicular to the longitudinal direction, constant along the entire sheath. Alternatively, it is not cylindrical.

According to one advantageous aspect of the invention, the circumferential yarn is interlaced with the longitudinal yarns. In this case, the circumferential yarn and the longitudinal yarns are part of a same ply, typically a same woven ply.

Alternatively, the circumferential yarn belongs to a first ply and the longitudinal yarns belong to a second ply separate from the first ply.

In other words, the circumferential yarn and the longitudinal yarns belong to different plies. In the first ply, the circumferential yarn is typically interlaced with longitudinal yarns with a high elasticity, such that the expansion of said first ply is always limited by the circumferential yarn.

Likewise, in the second ply, the longitudinal yarns are interlaced with one or more circumferential yarns with a high elasticity, such that the expansion of the ply at the first end is always limited by the longitudinal yarns.

The first and second plies are tubular. For example, the first ply is situated radially outside the second ply, or conversely, the second ply is situated radially outside the first.

According to a first example embodiment, each circumferential and/or longitudinal yarn is substantially inextensible, at least one segment of the circumferential and/or longitudinal yarn adopting a folded configuration in the rest state of the tubular sheath and a stretched configuration in the expanded state of the tubular sheath.

In other words, each circumferential and/or longitudinal yarn is of the type described in FR 2,910,047. This type of yarn has an elongation curve as a function of the traction force applied to the yarn having two very contrasting phases. In a first phase, the yarns have an extremely low tensile strength. From a certain elongation value, corresponding to the point where all of the folds of the yarn are developed, the tensile strength of the yarn becomes extremely high. For example, the yarn is made from Kevlar.

According to a second example embodiment, each circumferential and/or longitudinal yarn is of the type known under the name "structured yarn". These yarns are made from an inelastic material, and have a plurality of folds when no tension is present.

According to a third example embodiment, each circumferential and/or longitudinal yarn includes at least one yarn of a first type and at least one yarn of a second type, the yarn of the first type having a degree of tenacity lower than that of the yarn of the second type, the yarn of the second type having a degree of elasticity lower than that of the first type, the yarn of the second type, when a maximum predetermined elongation rate of the circumferential and/or longitudinal yarn is reached, being completely elongated and the yarn of the first type being wound in a spiral around the yarn of the second type, the yarn of the second type being wound in a spiral around the yarn of the first type when the circumferential and/or longitudinal yarn is at rest.

In other words, the circumferential and/or longitudinal yarn is of the type described in the application filed under number PCT/FR 2013/051381.

Advantageously, each longitudinal yarn has a maximum elongation rate from the rest state of the sheath substantially equal to $\pi/2$.

Such an elongation rate makes it possible to obtain a hemispherical profile at the first end of the inflatable sleeve.

According to one alternative embodiment, the tubular sheath is rigidly fixed to the mandrel along a plurality of circumferences, distributed longitudinally between the first and second longitudinal ends. The sleeve thus includes, in addition to rings making it possible to fix the tubular sheath and the casing to the mandrel, a plurality of intermediate rings. The intermediate rings are for example regularly longitudinally spaced apart, between the end rings. They rigidly fix each casing and the tubular sheath to the mandrel at a point of the central segment of the tubular sheath. They press the tubular sheath and the casing against the mandrel over their entire circumference, and prevent the expansion of the tubular sheath and the expansion of the casing along said circumferences.

When the casing is inflated, the sleeve thus includes a plurality of "bubbles" positioned longitudinally behind one another. Such a configuration makes it possible to obtain excellent tightness.

Alternatively, the separation between said circumferences along which the tubular sheath is fastened to the mandrel increases, from the first and/or second longitudinal end of the sleeve. One thus gives the sleeve a spindle shape at its end(s).

According to still another aspect, the invention relates to the use of the least one sleeve [having] the features above in a borehole successively crossing through first and second layers superimposed on one another, the first layer being relatively softer and more deformable, and the second layer being relatively harder and less deformable, the sleeve being positioned in the borehole, at the interface between the first and second layers. More specifically, the first longitudinal end of the tubular sheath is placed at the first layer, and the second longitudinal end is placed at the second layer. When the casing is inflated, the tubular sheath is pressed against the peripheral wall of the borehole, and exerts pressure thereon.

The first layer being softer than the second layer, the borehole has, at the first layer, a diameter slightly larger than the diameter of the same borehole at the second layer. The wall of the borehole therefore forms a shoulder at the interface between the layers. The sleeve marries the shape of the shoulder at the central part of the sheath.

BRIEF DESCRIPTION OF THE DRAWINGS

Other features and advantages of the invention will emerge from the following detailed description, provided for information and non-limitingly, in reference to the appended figures, in which.

DETAILED DESCRIPTION OF THE PREFERRED EMBODIMENTS

Figures 1, 2, 3, 4:
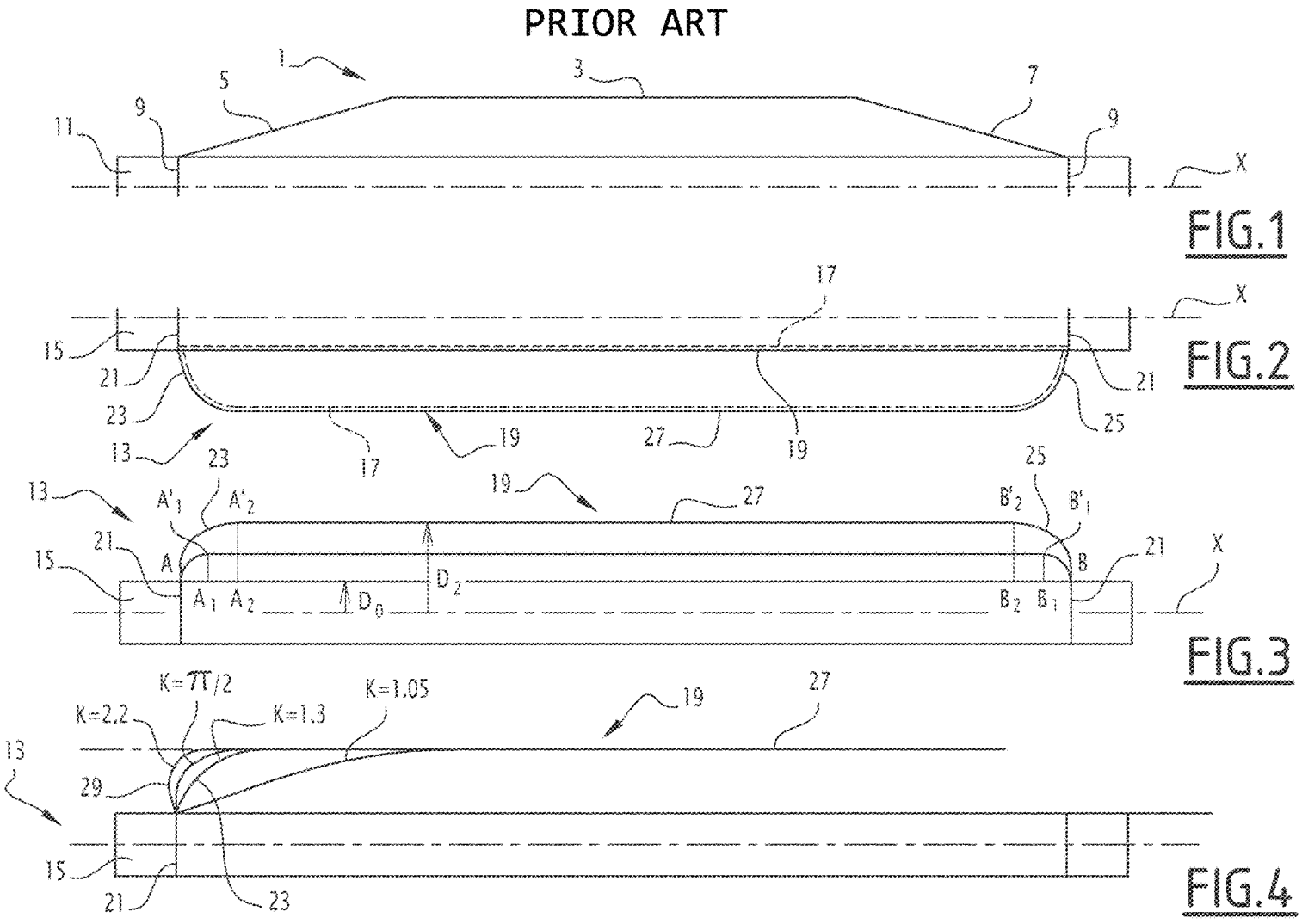
PRIOR ART FIG.1
FIG. 1 shows half of an inflatable sleeve according to the state of the art.
FIG. 2 is a view similar to that of FIG. 1, for a sleeve according to the invention.
FIG. 3 illustrates the deformation of the tubular sheath of the sleeve of FIG. 2, for different expansion states.
FIG. 4 illustrates a sleeve with a sheath in the expanded state, for different types of sheath having different longitudinal elongation capacities.

The inflatable sleeve shown in FIG. 2 is a packer used in diagraphy or exploitation of the subsoil, in particular. The sleeve 13 comprises a mandrel 15 extending in a longitudinal direction X, a tight inflatable casing 17 mounted around the mandrel 15, and a tubular sheath 19 slid around the inflatable casing 17. The casing 17 is shown in broken lines in FIG. 2. The inner volume of the casing 17 communicates with a pressurized gas source (not shown), via passages arranged in the mandrel 15. The casing 17 is therefore able to selectively adopt a state retracted around the mandrel 15 and a radially expanded state. The casing 17 is shown in both of its positions in FIG. 2.

The casing 17 is for example made from natural or synthetic rubber. Its opposite longitudinal ends are rigidly fixed to the mandrel 15 by means of rings 21.

In the retracted state, the casing 17 is for example pressed against the mandrel 15, and has a substantially cylindrical shape.

The tubular sheath 19 also has first and second longitudinal ends 23 and 25 rigidly fixed to the mandrel 15 by the rings 21. When the inflatable casing goes from its retracted state to its expanded state, it causes the expansion of the tubular sheath from its rest state to an expanded state. The two states of the tubular sheath are shown in FIG. 2.

In the rest state, the tubular sheath 19 is substantially cylindrical, and is pressed on the casing 10.

The expanded state is determined by the deformation characteristics of the sheath itself.

As shown in FIG. 3, in the expanded state, the tubular sheath 19 includes a substantially cylindrical central segment 27, the first and second ends 23 and 25 having, considered in section in a plane containing the longitudinal axis X, a substantially quarter-circle-shaped profile.

FIG. 3 shows the evolution of the profile of the tubular sheath 19 over the course of the inflation of the casing 17. When at rest, the sheath has a cylindrical shape with diameter D0, substantially corresponding to the diameter of the mandrel 15. The profile of the sheath is thus substantially rectilinear and extends from point A to point B.

In the expanded state, the profile of the tubular sheath is shown by line AA'2 B'2B. The segment A'2B'2 corresponds to the central segment 27 of the sheath. It has a diameter D2.

The lines A A'2 and B'2 B each draw a quarter circle, with center A2 and B2, respectively.

An intermediate expansion state is also shown in FIG. 3. The profile of the sheath is shown by line A A'1 B'1 B. The segment A'1B'1 is straight. However, the lines AA'1 and B'1B are quarter circles, the centers of which are respectively A1 and B1.

The radius of the quarter circle A A'1 is smaller than the radius of the quarter circle A A'2.

If one for example considers the segment AA2, the latter is straight when the sheath is at rest. One can see that when the sheath reaches the expanded state, the segment assumes the form of a quarter circle AA'2, the center of which is A2.

The length of the segment AA2 has therefore been elongated by a factor of Π/2. This same value of the elongation rate can be found for the intermediate inflation state. The segment AA1 has been elongated by a factor of Π/2. In order to obtain a profile with a strictly hemispherical shape at the ends of the sleeve, it is therefore necessary for the tubular sheath to have a longitudinal elongation capacity equal to Π/2 at least over the straight section AA2.

Furthermore, it is clear that, to allow the sheath to assume a quarter circle profile at its two opposite longitudinal ends, the following criteria must be respected:

- the central segment of the tubular sheath has a predetermined circumferential elongation capacity from the rest state of the tubular sheath; and
- the first and/or second ends of the tubular sheath have a longitudinal elongation capacity from the rest state of the tubular sheath comprised between 1.05 and 2.5, chosen to limit the diametric expansion of the first and/or second ends, the first and/or second ends of the tubular sheath having a circumferential elongation capacity from the rest state of the tubular sheath close to said predetermined circumferential elongation capacity of the central segment.

The circumferential elongation capacity from the rest state of the sheath will command the diameter D2 of the central segment of the sheath in the expanded state. Indeed, in the expanded state of the sheath, the central segment is in substantially the same longitudinal elongation state as in the rest state of the sheath. In other words, the segment A2B2 has the same longitudinal length as the segment A'2B'2.

FIG. 4 shows the profile of the first end 23 of the sheath as a function of the longitudinal elongation capacity from the rest state of said first end of the sheath.

This figure shows that if this longitudinal elongation capacity from the rest state is equal to Π/2, the end part 23 adopts a quarter circle profile. If the longitudinal elongation capacity is equal to 2.2, the first end has a profile protruding more than in the first case. More specifically, the segment of the sheath having a diameter D2 is longer. It comes up closer to the ring 21. Furthermore, the sheath has a curved surface 29, which extends longitudinally at the ring 21, or even past the ring 21.

Furthermore, due to the difference in longitudinal elongation between the first end 23 and the central segment 27, one can see slipping of the sheath from the central segment 27 toward this end 23. Indeed, during the inflation, the sheath is stretched at the end 23, while the sheath does not undergo longitudinal elongation in its central segment 27, as previously described. This causes gradual slipping of the sheath of the central segment toward the end 23, which causes an increase in the elongation capacity of the sheath in the end zone 23. One thus obtains a profile protruding more than that which corresponds to the elongation capacity of the sheath in its initial state.

Figure 7:
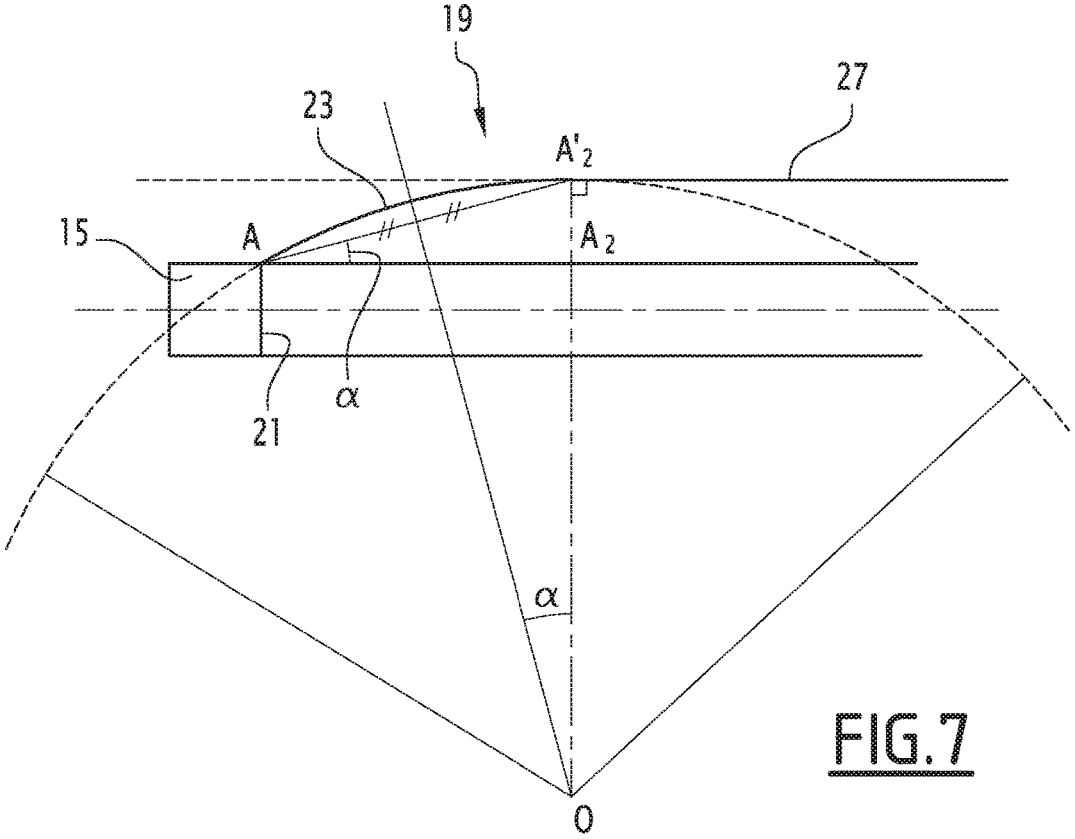
FIG. 7 shows a diagrammatic illustration of the profile of the sheath at its first end.

A similar effect can be obtained by giving the ring 21 the ability to slide on the mandrel 15 toward the central segment 27 during the expansion of the sheath. It is thus possible to obtain an arc of circle profile as described above with a sheath not having any longitudinal elongation capacity by providing a ring 21 able to slide over a travel equal to the difference in length between the circumference of the arc of circle $A\text{-}A'_2$ and the segment $AA_2$. As illustrated in FIG. 7, the profile of the sheath over this segment 23, $A\text{-}A'_2$ is in the shape of an arc of circle. This arc of circle passes through the point A, and connects tangentially to the segment 27 $A'_2\text{-}B'_2$. In order to obtain a given particular shape $A\text{-}A'_2$, the sheath must have an elongation capacity equal to $K_L$=Length of the arc $AA'_2/AA_2$, or in the example of FIG. 10, $K_L$=1.06.

If the longitudinal elongation capacity from the rest state is less than Π/2, and is for example equal to 1.8, the profile of the first end 23 protrudes less than when the elongation capacity is equal to Π/2. The portion of the sheath having a diameter D2 is shorter. It comes does not come up toward the ring 21 as much.

Figure 5:
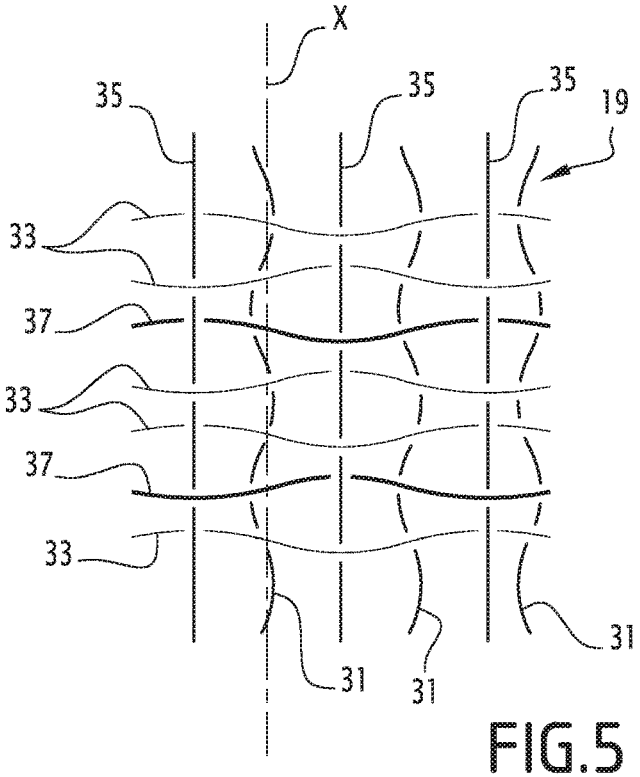
FIG. 5 shows the structure of a first type of tubular sheath.

In a first example embodiment, the sheath is a woven sheath as shown in FIG. 5.

The sheath then includes a plurality of inextensible longitudinal yarns 31 and at least one extensible circumferential yarn 33.

These yarns are for example each made from natural fibers such as cotton, linen or hemp, or glass fibers, carbon fibers, or organic fibers such as aramid, para-aramid, polyester, polypropylene, polyamide, etc.

These yarns form folds when the tubular sheath is in its rest state. When the sheath is subjected to longitudinal traction or traction in the direction of a radial expansion, the yarns become stretched and the folds are undone.

The sheath also includes longitudinal elastic yarns 35 and at least one circumferential elastic yarn 37. The elastic yarns 35 and 37 become elongated at the same time as the inextensible yarns 31 and 33. They serve, when the elastic yarns 31 and 33 are unfolded, to return these yarns toward their folded configuration.

The yarns 31, 35 are interlaced with the yarns 33, 37. The maximum elongation rate of the longitudinal yarns 31 depends on the number of folds formed in these yarns when the tubular sheath is in the rest state. Likewise, the maximum elongation rate of the circumferential yarn(s) is determined by the number of folds of these yarns in the rest state of the sheath.

In one example embodiment, the longitudinal yarns have a constant maximum elongation rate over their entire length. Likewise, each circumferential yarn has a constant maximum elongation rate over its entire length.

The elongation rate of the longitudinal yarns is for example comprised between 1.05 and 2.5, preferably comprised between 1.3 and 2.2, and still more preferably comprised between 1.4 and 1.8.

As a general rule, the maximum elongation rate of the longitudinal yarns is set at an appropriate value to give the sheath, once mounted on the sleeve, the desired longitudinal elongation capacity.

In the central segment 27 of the sheath, i.e., between the points A2 and B2 of FIG. 3, the maximum elongation rate from the rest state of the sheath of the circumferential yarn(s) 33 is set so as to obtain a diameter D2 of the sheath in the expanded state. For example, each turn of the circumferential yarn 33 must be able to go from a diameter D0 to the diameter D2, i.e., to elongate by a maximum elongation rate equivalent to D2/D0.

At the ends 23 and 25 of the sheath, in one example embodiment, one chooses to have the same maximum elongation rate for the circumferential yarn(s) as at the center of the sheath.

Figure 6:
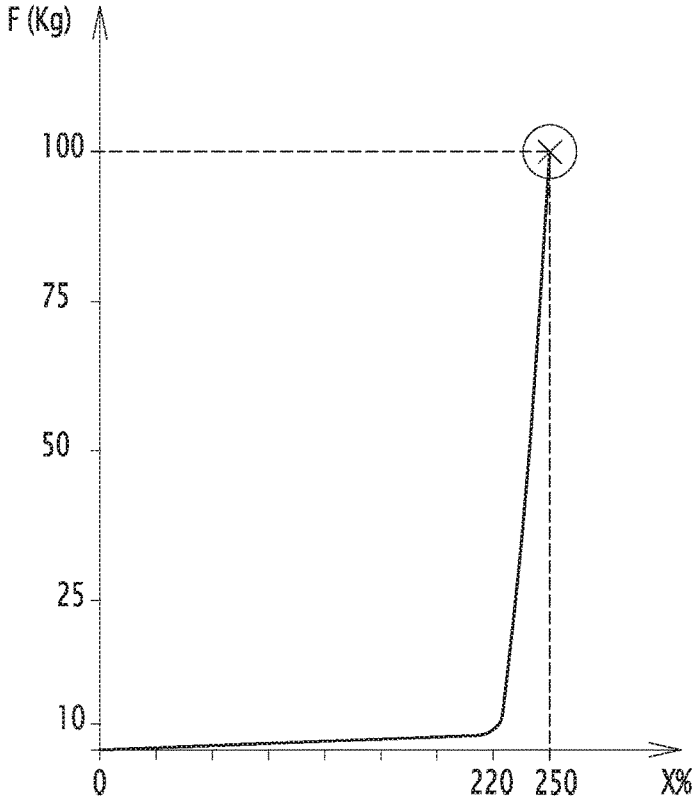
FIG. 6 illustrates the traction force/elongation curve for a yarn belonging to the structure of FIG. 5.

FIG. 6 shows the traction force F/elongation axis curve of an elastic yarn like the yarns 31 and 33. The elongation of 0% corresponds to the situation where the yarn is at rest, and is not subject to any traction. One can see that a high elongation, for example 220%, can be obtained with a moderate traction force, in the case at hand approximately 1 kg. However, once the yarn is completely unfolded, the tensile strength increases sharply. Indeed, the yarns 31 and 33 are made from a practically inextensible material. Thus, from 220%, it is only possible to obtain a small additional elongation, subject to a high traction force. Such a traction force is for example equal to 100 kg in the example of FIG. 6.

In a second embodiment, the sheath is woven with yarns called structured yarns. These yarns are made from an inelastic material, and have a plurality of folds when at rest. When they are subject to traction, the folds are undone and the yarns become elongated. When the traction is interrupted, the yarns return to a folded shape on their own. It is therefore not necessary for the sheath to include elastic yarns in addition to structured yarns. The structured yarns can have elongation rates of up to 2.5.

In a third embodiment, the sheath is woven with longitudinal yarns and at least one circumferential yarn that are each of the type described in the international patent application filed under number PCT/FR 2013/051381.

In an alternative embodiment that is not shown, the sheath is divided into two superimposed plies. A first ply incorporates the circumferential yarns with elastic, but not very strong longitudinal yarns, and the second ply incorporates the longitudinal yarns with elastic, but not very strong peripheral yarns. This makes it possible to eliminate the risks of wear of the peripheral yarns and the longitudinal yarns at their point of intersection.

Figure 8:
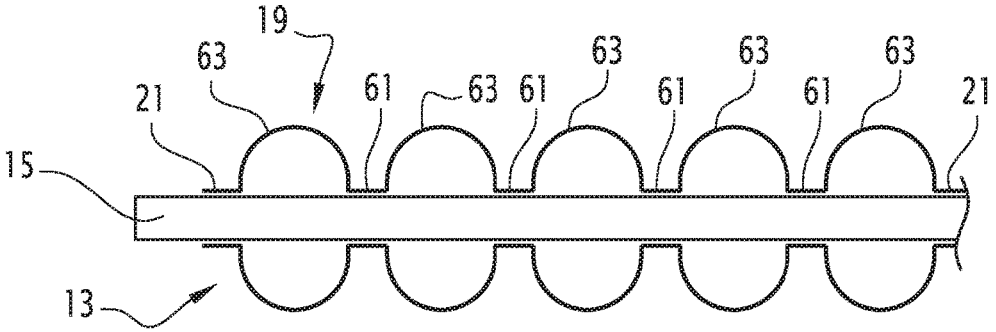
FIGS. 8 and 9 are simplified illustrations of alternative embodiments of the inflatable sleeve of the invention.

One alternative embodiment of the invention will now be outlined in reference to FIG. 8. Only the differences between the sleeve of FIG. 8 and that of FIGS. 1 to 4 will be outlined below. Identical elements or elements performing the same functions will be designated using the same references.

The sleeve of FIG. 8 includes, in addition to rings 21 making it possible to fix the tubular sheath 19 and the casing 17 to the mandrel 15, a plurality of intermediate rings 61. The intermediate rings 61 are regularly longitudinally spaced apart, between the end rings 21. They rigidly fix each casing 17 and the tubular sheath 19 to the mandrel 15 at a point of the central segment 27. They press the tubular sheath 19 and the casing 17 against the mandrel over their entire circumference. They prevent the expansion of the tubular sheath 19 and the expansion of the casing 17 along said circumferences.

FIG. 8 illustrates the sleeve 13 in the expanded state of the inflatable casing and the expanded state of the tubular sheath 19. FIG. 12 clearly shows that the sleeve 13 forms a plurality of bubbles 63 along the mandrel 11, each bubble 63 being formed between two intermediate rings 61 or between an end ring 21 and an intermediate ring 61.

The bubble 63 can have any type of shape, based on the separation between the two rings 21, 61 defining it. For example, the casing 17 and the tubular sheath 19 have toroid shapes. Alternatively, the casing 17 and the tubular sheath 19 can have, considered in radial section, a half-ellipsoid shape, or a shape with a cylindrical central segment and two arc of circle-shaped end segments.

Such a sleeve makes it possible to obtain excellent tightness when it is used as a packer in diagraphy or subsoil exploitation.

Figure 9:
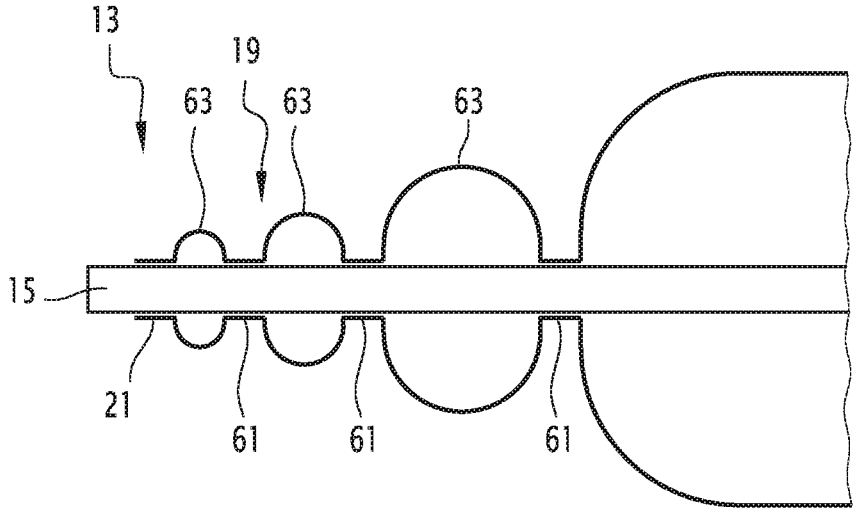

In an example embodiment illustrated in FIG. 9, the separation between the rings increases from the longitudinal end of the casing 17, i.e., the end ring 21. Thus, the longitudinal separation between the first intermediate ring 61 and the end ring 21 is smaller than the longitudinal separation between the first intermediate ring 61 and the second intermediate ring 61, and so forth.

It is thus possible to impart a spindle shape to the end segment of the sleeve 13, the bubbles 63 having a diameter increasing from the end ring 21.

Figure 10:
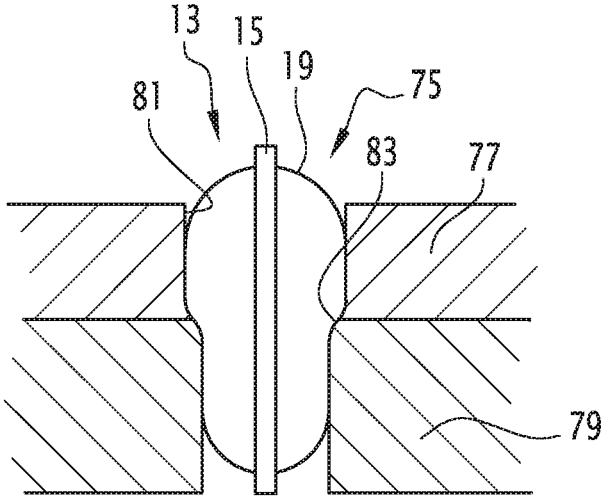
FIG. 10 is a simplified diagrammatic illustration of an advantageous use of the sleeve according to the invention.

FIG. 10 illustrates another particularly advantageous use of the inflatable sleeve of the invention.

The latter can be used in a well 75 crossing through terrain having layers with different hardnesses. In the illustrated example, the well 75 successively crosses through two layers 77 and 79, superimposed on one another. The layer 77 is relatively softer and more deformable. The layer 79 is relatively harder and less deformable. The sleeve 13 is positioned in the well 75, at the interface with the layers 77 and 79. More specifically, the first longitudinal end of the tubular sheath 19 is placed at the layer 77, and the second longitudinal end 25 is placed at the second layer 79. When the casing 17 is inflated, the tubular sheath 19 is pressed against the peripheral wall 80 of the well, and exerts pressure thereon.

The layer 77 being softer than the layer 79, the well 75 has, at the layer 77, a diameter slightly larger than the diameter of the same well at the layer 79. The wall 80 of the well therefore forms a shoulder 83 at the interface between the layers 77 and 79. The sleeve 13 marries the shape of the shoulder 83 at the central part of the sheath 19.

The sleeve of the invention is particularly well suited to marrying the shape of the shoulder 83, since the tubular sheath can adopt shapes with a diameter that varies very quickly, at its ends as well as in its central part.

The sleeves of the state of the art do not have the same particularly, and have the fault of exploding when they are positioned at the interface between two layers with different hardnesses, as illustrated in FIG. 10.

The inflatable sleeve can also be used to produce inflatable objects filled with a gas or a liquid and whose limit shape, when fully inflated, is similar to that of the sleeve described above.

What is claimed is:

1. An inflatable sleeve, the sleeve comprising:

a mandrel extending in a longitudinal direction;

an inflatable casing placed around the mandrel;

a tubular sheath slid around the casing, the tubular sheath having a central segment and first and second longitudinal ends situated on either side of the central segment, the first and/or second ends of the tubular sheath being fixed to the mandrel, the tubular sheath being extensible from a rest state to an expanded state;

wherein the tubular sheath is free with respect to the casing and is not embedded in the casing;

the tubular sheath has a predetermined circumferential elongation capacity from the rest state of the tubular sheath; and the first and/or second ends of the tubular sheath have a longitudinal elongation capacity from the rest state of the tubular sheath comprised between 1.05 and 2.5, chosen to limit the diametric expansion of the first and/or second ends of the tubular sheath and define the shape of the first and/or second ends, the longitudinal elongation capacity from the rest state being the ratio between the developed longitudinal length of the sheath segment when the latter is expanded as much as possible, and the longitudinal length of the same segment when the sheath is in the rest state of the tubular sheath.

2. The sleeve according to claim 1, wherein the central segment of the tubular sheath has said predetermined circumferential elongation capacity, and the first and/or second ends of the tubular sheath have a circumferential elongation capacity from the rest state of the tubular sheath close to said predetermined circumferential elongation capacity of the central segment.

3. The sleeve according to claim 1, wherein the central segment and the first and second ends of the tubular sheath have equal respective circumferential elongation capacities from the rest state of the tubular sheath.

4. The sleeve according to the claim 1, wherein the yarns of the tubular sheath comprise longitudinal yarns and at least one circumferential yarn, the circumferential yarn having a predetermined maximum elongation rate from the rest state of the tubular sheath, the maximum elongation rate of a yarn from the rest state referring to the ratio between the maximum possible length of the yarn and the length of the yarn when the tubular sheath is in the rest state of the tubular sheath; and the longitudinal yarns having a maximum elongation rate from the rest state of the tubular sheath comprised between 1.05 and 2.5 to limit the diametric expansion of the first end of the tubular sheath and define the shape of the first end, the maximum elongation rate of a longitudinal yarn from the rest state referring to the ratio between the maximum possible length of the longitudinal yarn and the length of the longitudinal yarn when the tubular sheath is in the rest state of the tubular sheath.

5. The sleeve according to claim 4, wherein the circumferential yarn is interlaced with the longitudinal yarns.

6. The sleeve according to claim 4, wherein the circumferential yarn belongs to a first ply, the longitudinal yarns belonging to a second ply separate from the first ply.

7. The sleeve according to claim 4, wherein each circumferential and/or longitudinal yarn is inextensible, at least one segment of the circumferential and/or longitudinal yarn adopting a folded configuration in the rest state of the tubular sheath and a unfolded configuration in the expanded state of the tubular sheath.

8. The sleeve according to claim 4, wherein each longitudinal yarn has a maximum elongation rate from the rest state of the sheath equal to $\pi/2$.

9. The sleeve according to claim 4, wherein each circumferential and/or longitudinal yarn is inextensible once the maximum elongation rate is reached.

10. The sleeve according to claim 4, wherein the tubular sheath is fixed to the mandrel by a plurality of intermediate rings distributed longitudinally between the first and second longitudinal ends.

11. The sleeve according to claim 1, wherein the circumferential elongation capacity from the rest state of the tubular sheath is constant along the entire tubular sheath.

12. The sleeve according to claim 1, wherein the tubular sheath is free with respect to the casing and is not embedded in the casing.

13. A method for closing off a borehole successively crossing through first and second layers of terrain superimposed on one another, the first layer being relatively softer and more deformable, and the second layer being relatively harder and less deformable, comprising positioning the sleeve according to claim 1 at an interface between the first and second layers.

* * * * *